United States Patent [19]

Hirata et al.

[11] 4,068,754

[45] Jan. 17, 1978

[54] APPARATUS FOR PILING UP PLATE-SHAPED ARTICLES

[75] Inventors: Toshinori Hirata, Yoshiki; Masamitu Yamada, Nei, both of Japan

[73] Assignee: Mitsui Mining & Smelting Co., Ltd., Tokyo, Japan

[21] Appl. No.: 663,913

[22] Filed: Mar. 4, 1976

[30] Foreign Application Priority Data

Mar. 14, 1975 Japan ..... 50-30753

[51] Int. Cl.[2] ..... B65G 57/06

[52] U.S. Cl. ..... 198/422; 271/192; 271/221

[58] Field of Search ..... 198/35, 422; 271/213, 271/192, 223, 224, 221, 222; 214/6 C, 6 D, 6 S

[56] References Cited

U.S. PATENT DOCUMENTS

| | | | |
|---|---|---|---|
| 1,633,937 | 6/1927 | Ford | 271/221 |
| 2,424,093 | 7/1947 | Harred | 214/6 D |
| 2,593,343 | 4/1952 | Rayburn et al. | 271/213 X |
| 3,124,059 | 3/1964 | Labombarde | 271/192 UX |
| 3,288,312 | 11/1966 | Hughes et al. | 214/6 D |
| 3,358,853 | 12/1967 | Thomas et al. | 271/192 X |
| 3,381,829 | 5/1968 | Turner | 271/192 X |
| 3,382,966 | 5/1968 | Califano et al. | 198/35 |
| 3,447,695 | 6/1969 | Krepp et al. | 271/192 X |
| 3,459,300 | 8/1969 | McGuire | 198/35 X |
| 3,675,791 | 7/1972 | Russell et al. | 271/192 X |
| 3,848,725 | 11/1974 | Toby | 198/35 |

FOREIGN PATENT DOCUMENTS

| | | | |
|---|---|---|---|
| 648,541 | 9/1962 | Canada | 271/224 |
| 661,828 | 4/1963 | Canada | 271/221 |
| 6,618,025 | 6/1967 | Netherlands | 271/221 |
| 286,777 | 3/1928 | United Kingdom | 271/213 |

*Primary Examiner*—Evon C. Blunk
*Assistant Examiner*—Richard K. Thomson
*Attorney, Agent, or Firm*—Blanchard, Flynn, Thiel, Boutell & Tanis

[57] ABSTRACT

An apparatus for the purpose of piling up a prescribed number of plate-shaped articles in trim order, said apparatus comprising chain conveyers which are installed below a receiving member for temporarily supporting the plate-shaped articles and accommodated in a frame, chutes which are disposed on both sides of said conveyers, and fore adjusting plates and rear adjusting plates which are disposed to be perpendicular to the direction of progress of the chain conveyer and capable of reciprocating between a vertical position and an outwardly inclined position relative to said direction of progress of the chain conveyer, whereby said piling-up work can be performed by driving said adjusting plates.

6 Claims, 5 Drawing Figures

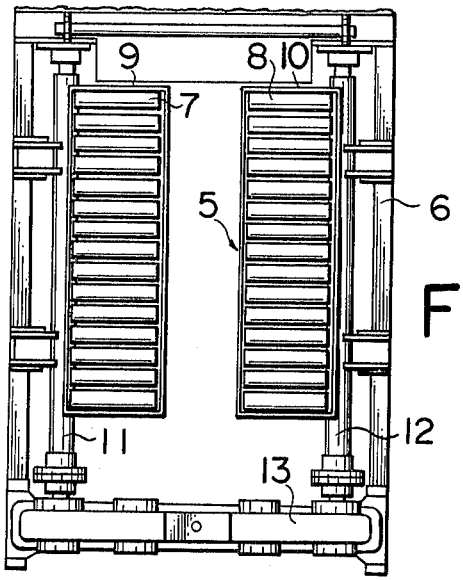
FIG. 2
FIG. 4
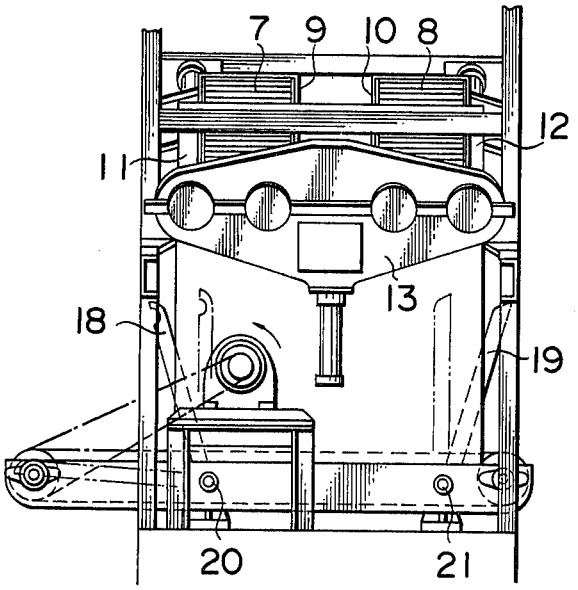

APPARATUS FOR PILING UP PLATE-SHAPED ARTICLES

BACKGROUND OF THE INVENTION a. Field of the Invention

This invention relates to an apparatus for the purpose of piling up a prescribed number of plate-shaped articles in trim order to be convenient for handling the plate-shaped article afterwards.

b. Description of the Prior Art

On the occasion of piling up a plurality of plate-shaped articles in conveyance, they are often piled up very loosely, resulting in difficulty in their handling at the time of transportation, storing and so forth afterwards. Therefore, in the case of their having been piled up too disorderly, it is necessary to pile them over again, and this requires much labor, entailing various troubles from the view point of the work efficiency as well as the safety of work.

SUMMARY OF THE INVENTION

The object of the invention is to provide an apparatus for the purpose of piling up plate-shaped articles — such as the electrodeposited metal plate peeled off its base plate by means of a mechanical peeling off machine — which is devised such that, said plate-shape articles are always induced to a prescribed position, let fall on chain conveyors while the number thereof is counted, are subjected to adjustment of their direction each time a piece of them thus falls by means of adjusting plates, and automatically forwarded to the next process upon completion of piling-up of a prescribed number thereof with the actuation of the chain conveyers, thereby rendering it possible to economize in labor for the piling-up work and ensure the safety of work.

For this purpose, the present invention is characterized in that, on both sides of the chain conveyors are installed the chutes as disposed parallel to the direction of progress of the chain conveyor, while along a direction perpendicular to the direction of progress of the chain conveyer are installed the fore adjusting plates and the rear adjusting plates as positioned to confront the fore edge and the rear edge, respectively, of the plate-shaped article.

BRIEF DESCRIPTION OF THE DRAWINGS

In the appended drawings:

FIG. 2 is a plane-view of the right half of the bilateral inclined rotary conveyors shown in FIG. 1;

FIG. 4 is a side view of said adjusting means; and

DETAILED DESCRIPTION OF THE INVENTION

Hereunder will be explained the mode of operation of an embodiment of the present invention in the case of piling up the electrodeposited metal plates peeled off cathode plates with reference to the appended drawings.

Figure 3:
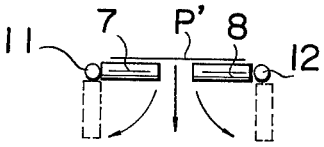
FIG. 3 is a diagram illustrative of the mode of working of said inclined rotary conveyor.
Figure 5:
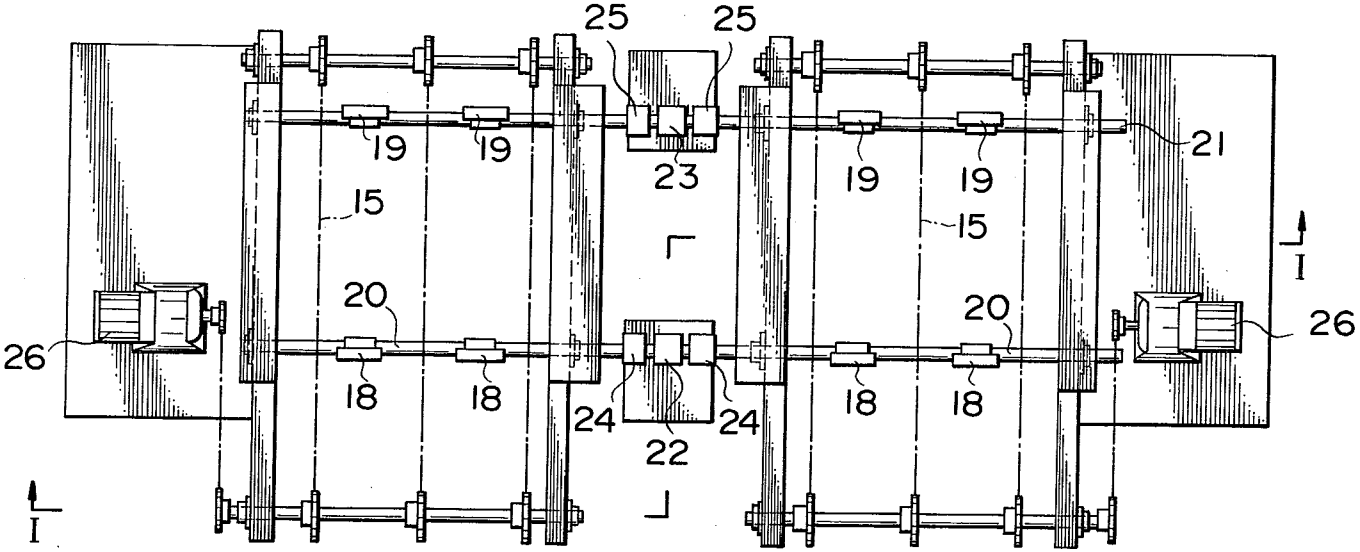
FIG. 5 is a plane-view of the adjusting means as well as the chain conveyers.

Referring to drawings, the cathode plate P subjected to an appropriate hammering work by means of a hammering apparatus (not shown in the drawing) is put on the chain conveyer 1 which is actuated intermittently by means of a motor (not shown in the drawing) and is sent to the peeling off apparatus 2. The peeling off apparatus 2 consists of wedges 3 capable of ascent and descent by means of an oil pressure cylinder (not shown), and clamp 4 holds fast the cathode plate at the time of peeling-off work, etc. whereby the cathode plate stopped at the peeling off apparatus has the electrodeposited metal plates P' peeled off two sides thereof by means of a couple of wedges 3 and the thus peeled off electrodeposited metal plates P' fall on the bilateral inclined rotary conveyers 5. These inclined rotary converyers are designed such that central crossfeed conveyer side is high and inclines toward right and left forming an angle of about 15° relative to a horizontal level. The bilateral inclined rotary conveyers 5 are respectively equipped with a main frame 6, two sets of roller conveyers 7, 8, and outer frames 9, 10 whose outside are fixed to the shafts 11, 12, respectively; when the shafts 11, 12 turn by 90° in the direction of arrows as shown in FIG. 3, the roller conveyers 7, 8 fixed to the shafts 11, 12 also turns to open inwards thereby to let fall the electrodeposited metal plates placed on the conveyers. Of the main frame 6 for the inclined rotary conveyer, the lowest portion constitutes a gear box 13 in which are provided pinions fitted on the shafts 11, 12 and a gear wheel to engage with each said pinions together with a rack driven by a pressure cylinder 14, whereby said couple of roller conveyers 7, 8 on the frame are capable of simultaneously turning to open inwards or return to their initial position in concert with the reciprocation of the oil pressure cylinder 14.

Below each inclined rotary conveyor 5 are installed three stretches of chain conveyors 15 parallel to the crossfeed conveyer 1, so that the peeled off electrodeposited metal plates P' fallen from the conveyer 5 can be piled up on the chain conveyers 15. Along two sides of these three stretches of chain conveyers 15 are installed the guide chutes 16, 17 parallel to said chain conveyers, said chutes functioning to induce the electrodeposited metal plates to be piled up along the direction parallel to the chain conveyers at the time when the metal plates fall from the inclined rotary conveyers 5. While, as to the adjustment of the piling-up of said metal plates along the direction parallel to the chain conveyer 15, there are provided the fore adjusting plates 18 for the front (along the normal direction of progress of the chain conveyer) and the rear adjusting plates 19 for the rear (along the opposite direction of progress of the chain conveyer), the base of said adjusting plates being fixed to the shafts 20, 21, respectively. The shafts 20, 21 are connected to the oil pressure motors 22, 23 disposed in the middle of the respective shafts by means of the couplings 24, 25. The shafts 20, 21 are actuated by the respective oil pressure motor and accordingly the fore and the rear adjusting plates turn by a prescribed angle, come into an upright position and again return to their normal position as shown in FIG. 4. Inasmuch as the normal position of the respective adjusting plates is a position somewhat inclined (e.g., by about 15°) outward relative to a perpendicular position, at the time when an electrodeposited metal plate falls, initial adjustment can be performed.

Figure 1:
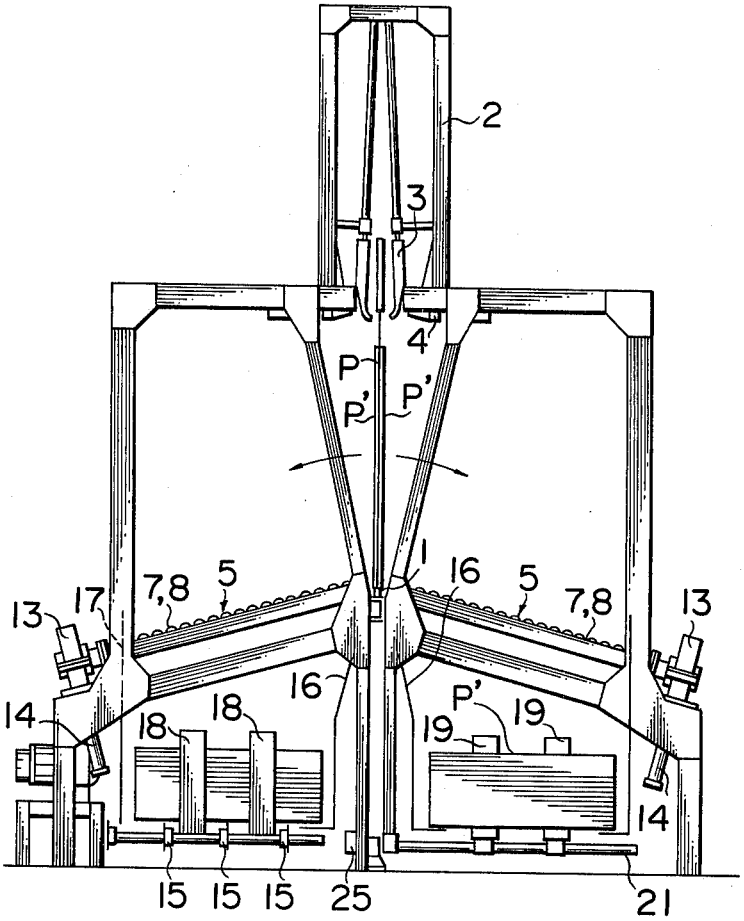
FIG. 1 is a front view including a peeling off apparatus, bilateral inclined rotary conveyers, and an adjusting means which is the same as that in FIG. 5 and shown by partially cutting along the line I—I therein.

When the cathode plate P arrives at the peeling off apparatus 2, the wedges 3 peel the electrodeposited metal plates P' attached to both sides of the cathode plate gradually beginning with the upper part thereof, and the peeled-off metal plates P' fall on the inclined rotary conveyers as indicated by the arrow in FIG. 1. The inclined rotary conveyers 5 for receiving the electrodeposited metal plates incline toward right and left as illustrated in FIG. 1, and on the surface thereof are arranged two rows of smoothly rotatable roller conveyers so that all the electrodeposited metal plates deposited on the inclined rotary conveyers slide down against the chutes 17 provided along the right and left extremities of said conveyers and stop thereat. Accordingly, the top of each electrodeposited metal plate along the direction parallel to the crossfeed conveyer is made even by the chute 17, and through actuation of a sensing means provided at this position, which is not shown in the drawing, the fall of the electrodeposited metal plate is remembered and also the oil pressure cylinder 14 is actuated. By the operation of the oil pressure cylinder 14, the rack, gear wheel and pinion provided in the gear box 13 work, the shafts 11, 12 are simultaneously rotated, and the roller conveyers 7, 8 fixed on these shafts are simultaneously turned as indicated by arrows in FIG. 3, whereby the electrodeposited metal plates are let fall from the inclined rotary conveyer.

At the time when the electrodeposited metal plates P' are let fall from the inclined rotary conveyer and piled up on the three stretches of chain conveyers 15, as for the position of the metal plate in a direction perpendicular to the crossfeed conveyer 1, it is regulated by the chutes 16, 17. While, as for the position thereof in a direction parallel to the conveyers 15, inasmuch the fore adjusting plates 18 and the rear adjusting plates 19 are so devised as to incline outward by about 15° relative to the vertical direction, the metal plate is first approximately arranged by means of these inclined adjusting plates with respect to the direction to the conveyer 15.

Next, by sensing the return of the inclined rotary conveyer 5 to its initial position by means of a sensor, and actuating the oil pressure motors 22 and 23, the shafts 20 and 21 are rotated. Consequently, both adjusting plates fixed to these shafts 20 and 21 are made to stand up in a vertical position respectively, whereby the direction of going in and out of the metal plate parallel to the conveyers 15 can be accurately adjusted. Thus, the rear adjusting plates 19 return to their initial normal position automatically immediately after standing up in a vertical position; and as for the fore adjusting plates 18, at the time when they have come in a vertical position, they are sensed by a sensing means (not shown in the drawings) and are turned so as to be restored to their initial position, and then, under the direction of a sensing means not shown in the drawings which indicates where to return, they return to their initial position inclined outward by about 15° and stop there.

Meanwhile, the number of electrodeposited metal plates piled up on the chain conveyers is indicated on a counter through a sensing means (not shown) for detecting the number of peeled off metal plates shown in the drawings. When a prescribed number of electrodeposited metal plates is attained, the motor 26 is actuated to operate the chain conveyers 15, whereby the piled-up metal plates are forwarded to the next process. On this occasion, if the fore adjusting are held in their normal positions, they will impede the discharge of the electrodeposited metal plates. Therefore, the present invention is so devised that when the counter indicates the attainment of a prescribed number of piled-up metal plates, the fore adjusting plates 18 adjust the pile of metal plates upon the fall of the last one of the prescribed number of metal plates and then a practically horizontal position which will not impede the transfer of said metal plates by the chain conveyers, thereby to let the metal plates pass on the lying fore adjusting plates, and after the passage of the metal plates in this way, the fore adjusting plates return to their initial positions. Thus, the electrodeposited metal plates peeled off by the peeling off apparatus can be always put in order at the lowest end of the inclined rotary conveyer as a result of falling on said rotary conveyer, while the inclined rotary conveyer is supposed to turn and open inwards two roller conveyers simultaneously by means of a single oil pressure cylinder, thereby to let fall the metal plates put on the roller conveyers while maintaining every metal plate in a horizontal position as far as possible by preventing one edge thereof from going ahead of the opposite edge in falling. And, at the time of said falling, as regards the direction perpendicular to the crossfeed conveyer for cathode plates, it is possible to let the electrodeposited metal plate fall on the chain conveyers by means of the confronting chutes, while as regards the direction parallel to the crossfeed conveyer for cathode plates, by virtue of the provision of the fore and the rear adjusting plates inclined outward, approximate adjustment can be first conducted each time an electrodeposited metal plate falls, and then, by erecting these inclined adjusting plates vertically, the going in and out of the cathode plates along the direction perpendicular to the crossfeed conveyer can be accurately adjusted. Each time a cathode plate arrives at the peeling off position, the number of peeled-off metal plates is counted by the counter, and when a prescribed number of peeled-off metal plates is thus attained, the fore adjusting plates lie athwart to come into a practically horizontal position, the chain conveyer is actuated and the piled-up electrodeposited metal plates are forwarded to the succeeding process.

As described in the foregoing, the present invention renders it possible to pile up a prescribed number of plate-shaped articles like peeled-off electrodeposited metal plates — which are otherwise apt to be piled up disorderly and loosely — to be in trim order in respect of all directions, and brings on a remarkable effect on the work efficiency and the safety of operations.

It goes with saying that the scope of the present invention is not limited to the above embodiment.

What is claimed is:

1. An apparatus for handling and stacking electrodeposited metal plates, comprising:

movable conveyer means adapted to have said plates supported and stacked thereon;

plate receiving means positioned above said conveyer means for initially receiving said plates thereon and then depositing said plates on said conveyer means, said receiving means when in a plate receiving position having means defining an upwardly facing support surface which is inclined at a small angle with respect to the horizontal, said last-mentioned means permitting slidable movement of a plate along said surface toward the lower end of said receiving means, and stop means associated with said receiving means for holding the plate on said receiving means in a selected position;

said receiving means including a pair of substantially identical receivers positioned in side-by-side relationship, and means swingably mounting said receivers for swinging movement in opposite rotational directions between said plate receiving position and a lowered position which permits the plate on said receiving means to be dropped onto said conveyer means;

chute means disposed on opposite sides of said conveyer means and extending along a direction parallel to the direction of movement of said conveyer means, said chute means causing the plates as deposited from said receiving means onto said conveyer means to be positionally aligned one above the other in a direction which is perpendicular to the direction of movement of said conveyer means, whereby said chute means cooperates with the side edges of said plates for guiding same into the proper position; and adjusting means associated with the conveyer means and cooperating with the front and rear edges of said plates for positioning the stacked plates in aligned relationship in a direction which is substantially parallel to the direction of movement of said conveyer means;

said adjusting means including front and rear vertically elongated adjusting members which are horizontally spaced apart in the direction of movement of said conveyer means and are positioned for respectively cooperating with the front and rear edges of the stacked plates, said adjusting members having the lower ends thereof disposed adjacent said conveyer means, said lower ends being pivotally supported so that said adjusting members are swingably movable in a vertical plane which extends parallel with the direction of movement of said conveyer means, said adjusting members being swingably movable between a normal position wherein the adjusting members project upwardly and are slightly inclined outwardly away from the vertical and away from the stacked plates and an alignment position wherein the adjusting members project vertically upwardly for causing accurate alignment of the stacked plates along the direction of movement of said conveyer means, said adjusting members when in said normal position acting as upwardly projecting diverging guides for causing each plate as dropped from said receivers to be approximately aligned with the stack along the direction of movement of said conveyer means;

said adjusting means including means for sensing the dropping of each said plate from said receivers onto said conveyor means and for simultaneously swinging said adjusting members in opposite rotational directions toward one another into said alignment position for causing each plate to be individually accurately aligned on the stack, said adjusting means also including means for causing vertical swinging movement of said front adjusting member into a lowered substantially horizontal position after a preselected number of plates have been stacked to permit substantially horizontal movement of the stack by said conveyer means whereby said stack passes over said front adjusting member when it is in said lowered position.

2. An apparatus according to claim 1, wherein each of said receivers includes a plurality of elongated cylindrical rollers which are supported for rotation about axes which extend perpendicular to the inclined direction of the respective receiver, said rollers defining said support surface, said inclined direction being substantially perpendicular to the direction of movement of said conveyer means, and each said receiver being rotatably swingable about an axis which is parallel to said inclined direction.

3. An apparatus according to claim 1, including a conveyer device positioned vertically above and extending substantially parallel to said conveyer means, said conveyer device also being positioned above said plate receiving means, said conveyer device having means for suspending said plates therefrom so that said plates when supported on said conveyer device are disposed in a substantially vertical plane which extends substantially parallel to the direction of movement of both said conveyer device and said conveyer means.

4. An apparatus according to claim 3, wherein said plate receiving means projects outwardly from one side of said vertical plane and is positioned so that the upper end thereof is disposed closely adjacent said vertical plane and the support surface projects sidewardly away from said vertical plane and is inclined downwardly with respect to the horizontal, wherein a second plate receiving means identical to said first-mentioned plate receiving means is positioned on the opposite side of said vertical plane and projects outwardly and downwardly therefrom in a manner identical to said first-mentioned plate receiving means, and wherein said conveyer means includes first and second conveyers which are respectively positioned under said first-mentioned and second plate receiving means, each of said conveyers having said chute means and said adjusting means associated therewith.

5. An apparatus according to claim 1, wherein said chute means includes a first guidelike chute member positioned adjacent one side of said conveyer means and projecting vertically upwardly therefrom, said chute means including a second guidelike chute member positioned adjacent the other side of said conveyer means and projecting upwardly therefrom, said second chute member having at least the upper portion thereof inclined outwardly as it projects upwardly to assist in guiding the plate which is dropped from said receiver onto said conveyer means.

6. An apparatus according to claim 5, wherein said first chute member is positioned under the lower end of said receiving means and projects upwardly so that the upper end of said first chute member defines said stop means, and said second chute member being positioned under and in the vicinity of the upper end of said receiving means.

* * * * *